US006940471B2

(12) United States Patent
Smith

(10) Patent No.: US 6,940,471 B2
(45) Date of Patent: Sep. 6, 2005

(54) HELICAL ANTENNA

(75) Inventor: Mark Smith, Winnellie (AU)

(73) Assignee: Syntonic Technologies Pty Ltd, Frankston (AU)

( * ) Notice: Subject to any disclaimer, the term of this patent is extended or adjusted under 35 U.S.C. 154(b) by 0 days.

(21) Appl. No.: 10/475,737

(22) PCT Filed: Apr. 23, 2002

(86) PCT No.: PCT/AU02/00505

§ 371 (c)(1),
(2), (4) Date: Oct. 23, 2003

(87) PCT Pub. No.: WO02/087017

PCT Pub. Date: Oct. 31, 2002

(65) Prior Publication Data

US 2004/0125041 A1 Jul. 1, 2004

(30) Foreign Application Priority Data

Apr. 23, 2001 (AU) ..... PR4526

(51) Int. Cl.[7] ..... H01Q 1/36
(52) U.S. Cl. ..... 343/895; 343/840
(58) Field of Search ..... 343/840, 867, 343/895

(56) References Cited

U.S. PATENT DOCUMENTS

| | | | | | |
|---|---|---|---|---|---|
| 3,596,273 | A | | 7/1971 | Francis et al. | 343/793 |
| 3,940,772 | A | | 2/1976 | Ben-dov | 343/853 |
| 3,999,186 | A | * | 12/1976 | Majkrzak et al. | 343/709 |
| 4,087,820 | A | * | 5/1978 | Henderson | 343/752 |
| 4,163,981 | A | | 8/1979 | Wilson | 343/715 |
| 4,427,984 | A | | 1/1984 | Anderson | 343/764 |
| 4,725,843 | A | | 2/1988 | Suzuki et al. | 343/359 |
| 5,146,235 | A | * | 9/1992 | Frese | 343/895 |
| 5,191,352 | A | | 3/1993 | Branson | 343/895 |
| 5,274,393 | A | | 12/1993 | Scott | 343/895 |
| 5,346,300 | A | | 9/1994 | Yamamoto et al. | 343/895 |
| 5,349,365 | A | | 9/1994 | Ow et al. | 343/875 |
| 5,436,633 | A | | 7/1995 | Liu | 343/723 |
| 5,485,170 | A | | 1/1996 | McCarrick | 343/895 |
| 5,489,916 | A | * | 2/1996 | Waterman et al. | 343/895 |
| 5,604,972 | A | | 2/1997 | McCarrick | 29/600 |
| 5,612,707 | A | | 3/1997 | Vaughan et al. | 343/895 |
| 5,721,558 | A | | 2/1998 | Holemans | 343/895 |
| 5,990,841 | A | * | 11/1999 | Sakamoto et al. | 343/749 |
| 6,172,655 | B1 | | 1/2001 | Volman | 343/895 |
| 6,685,798 | B1 | * | 2/2004 | Holland et al. | 156/345.48 |

FOREIGN PATENT DOCUMENTS

| | | |
|---|---|---|
| AU | 686254 | 12/1993 |
| EP | 469 741 B1 | 5/1995 |
| GB | 2351849 | 1/2001 |
| WO | WO93/06631 | 4/1993 |
| WO | WO93/22804 | 11/1993 |
| WO | WO96/18220 | 6/1996 |
| WO | WO96/19846 | 6/1996 |
| WO | WO98/15028 | 4/1998 |

* cited by examiner

*Primary Examiner*—Tho Phan
(74) *Attorney, Agent, or Firm*—Klauber & Jackson

(57) ABSTRACT

This invention relates to antennae and in particular to antennae of the multi-element helically wound type. An helical antenna according to the invention has at least one conductive helix having a vertically orientated central longitudinal axis wherein the helix is fixed at one end and rotatable at the opposite end; a non-conductive constant diameter support means located coaxial with said at least one conductive helix adapted to support said at least one conductive helix; and rotation means attached to said rotatable end of each of said at least one conductive helix arranged to change the pitch of said at least one conductive helix while maintaining the diameter of said at least one conductive helix to affect manipulation of the antenna pattern in gain and azimuth.

21 Claims, 11 Drawing Sheets

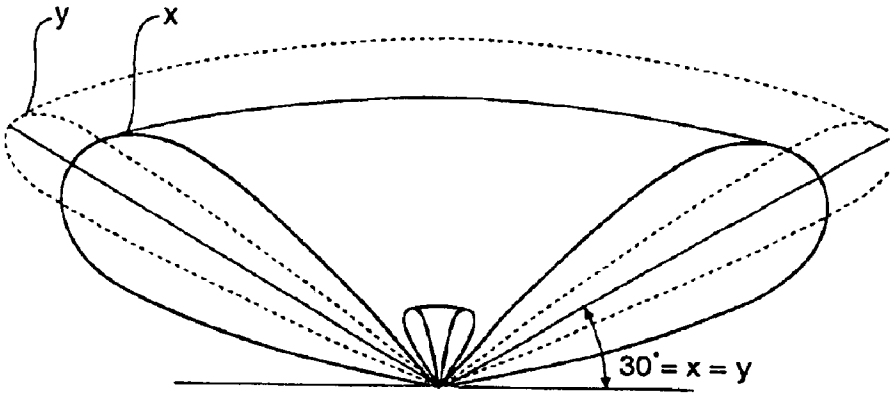
Fig 4C
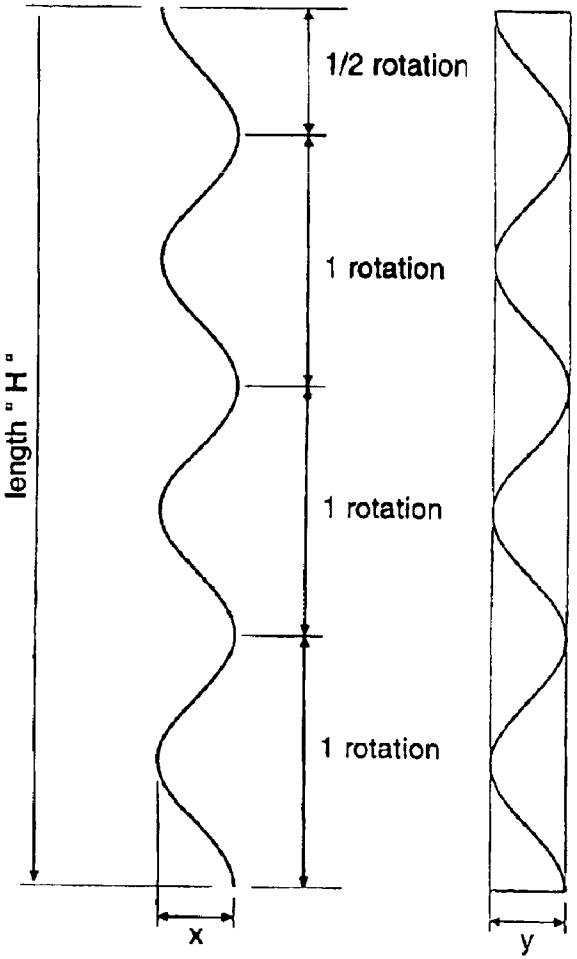
Fig 4A
Fig 4B

Section A-A

HELICAL ANTENNA

This invention relates to antennae and in particular to antennae of the multi-element helically wound type.

BACKGROUND

An antenna is used to transmit and receive electromagnetic energy typically in the form of radio frequencies upon which have been modulated telephony and data communications.

In this specification most of the disclosure will relate to antennae suitable for use from a mobile platform for facilitating communication between that mobile platform and a satellite. However, it is not the intention of the inventors to imply any limit in the way the antenna according to the invention could be used. It is not inconceivable for the antenna the subject of this disclosure to be useful in radar applications, cellular mobile and base station communication systems and others including fixed and mobile platform applications. Some discussion of these alternative uses will be given but the majority of the disclosure will relate to the mobile-satellite environment. One or more combinations of features described herein are likely to be useful in other applications and the mobile-satellite examples are provided mainly by way of illustration of those features.

Satellites provide an advantageous location for one or more radio communications transponders and a variety of types of land based antennae have been used to receive and transmit to them.

Satellites permanently positioned some 36,000 kilometres above the equator are geographically stationary hence they are referred to as geo-stationary satellites. Geo-stationary satellite antennae are orientated towards the earth and transmit to and receive radio frequency energy to and from a predetermined area of the earth's surface, commonly referred to as its footprint.

A fixed location transceiver within a geo-stationary satellite's particular footprint uses an antenna that is orientated directly towards the relevant satellite. An antenna that receives and transmits signals to and from distant satellites is designed to have maximum gain in a particular direction (unidirectional). Therefore it is necessary to accurately mechanically orientate that antenna so that the pattern of its maximum gain (transmission and reception) is orientated towards a particular geo-stationary satellite. Antennae with large gains are preferable however these will typically have large dimensions and a specialized shape and a narrow maximum gain beam width (power spread of the optimum transmit and receive signal to and from the antenna) which thus requires very accurate alignment with the satellite. Parabolic antennae are an example of such an antenna and are typically used by fixed location users of geo-stationary satellites.

The intervention of adverse weather can reduce the amount of signal received by any type of antenna but it is particularly disadvantageous at frequencies used in satellite systems. Consequently geo-stationary antenna are designed to have the highest possible gains to minimise these effects which thus necessitates large dimensions and narrow beam widths.

Mobile users are also able to use geo-stationary satellites. However, their mobile transceiver equipment must be of the highest quality and more importantly the antenna used with that equipment must be capable of receiving and transmitting at all times in the direction of the satellite which obviously is moving relative to the mobile user.

Some very bulky and expensive parabolic antennae exist for mobile users but typically the mobile user is ideally and typically forced to be stationary while communicating via the satellite with that type of antennae.

There do exist, antenna that can be used from a moving platform (eg a vehicle). One such form of antenna is a very expensive, electrically steerable antenna. This type of antenna however is typically of lower gain that other alternatives since it trades-off signal transmission and reception efficiency for a low profile and convenient operation.

In a mobile environment it is preferable to use an antenna that can quickly re-oriented itself without operator intervention as the mobile user moves throughout the footprint of one satellite antenna or has to change satellites as it moves to another footprint. The antenna will also need to change its orientation when the vehicle moves over uneven ground or changes direction. It may also need to change its orientation quickly back and forth between satellites as it travels in the region of an overlap between two satellite antenna footprints. The latter process of changing satellites is called hand-over and is handled in a number of ways by not only the mobile but also the satellite system, the most common methods of hand-over being referred to as soft and hard.

In geo-stationary satellite communication systems hand-overs occur less often than in telephony cellular systems due to the very large footprints of geo-stationary satellites but a mobile antenna must contend with the other design considerations described above none the less.

Low earth orbit (LEO) satellites circle some 250–1500 kilometers above the earth's surface, and their footprints are smaller than geo-stationary satellites and are also continually moving across the earth's surface swathe like. LEO satellite communications systems provide an alternative to geo-stationary satellite communications systems. However, many more low-earth satellites than geo-stationary satellites are required to provide adequate coverage of the earth's surface. LEO satellites relay radio communications between fixed and mobile users via a system that is also connected to the Plain Old Telephone System (POTS), also known as the Pubic Switched Telephone Network (PSTN). They can also provide features akin the increasingly feature rich cellular digital networks including access to the global computer network commonly referred to as the Internet.

However, the communications system, which supports a LEO satellite relay function is substantially more complicated than that of the geo-stationary satellite relay function as discussed very briefly above. A LEO satellite system uses some 40 to 70 satellites to provide overlapped footprints that simultaneously provide cover over the majority of the surface of the earth (the polar regions are sometimes excluded). Thus, a user wherever they may be, will typically be within the footprint of at least two and ideally three or more low-earth orbit satellites at any one time.

Thus, in a low-earth orbit satellite system both stationary and mobile users it is preferable for their antennae to be able to track the path of the satellite providing the best signal available at any particular time. However, in practice a relatively low gain dipole antenna is used that consequently requires a high transmit power and sensitive receiver.

Both mobile and LEO support systems need to implement a well structured hand-over mechanism so that a link involving for example a telephony conversation can be handed over from one satellite to another with little or no loss of continuity or intelligibility to the users of the system.

Thus the complexity and power requirements of a LEO mobile and satellite transceiver is greater so that it can handle frequent hand-overs.

Preferably therefore, a mobile antenna for a LEO system will have both frequency and directional agility.

Since a low earth satellite is closer to the earth's surface the signals received by users on the earth's surface are much greater than those received from geo-stationary satellite users. Thus mobile antennae used in LEO systems can be smaller and have less gain than those used by geo-stationary satellite mobile users.

Thus regardless of the satellite system being used, desirable features of mobile antennae include Omni-directionality of transmission and reception in the horizontal plane as well as exhibiting appreciable gain in the full range of azimuth angles.

In this specification the term azimuth is typically used to describe the angle of elevation, of a beam of the radiation of an antenna, above the horizontal plane. The horizontal plane is orthogonal to and centred on what is also typically the vertical axis of the antenna with respect to the earth's surface. The horizontal plane is nominally centred at or near the base of the active element of the antenna or is coincident with the electrical ground plane of the antenna. However, the antenna disclosed in this specification may be used, as will be explained, in many configurations. Consequently in use, the longitudinal axis of the antenna will not always be vertically orientated with respect to the earth's surface. In some applications it may be used upside down and in others it may be used on its side, all with respect to the earth's surface. Thus the angle of elevation, referred to herein as its azimuth, is relative to the plane orthogonal to the longitudinal axis of the antenna.

That is to say, a satellite antenna would be ideal if it did not matter what orientation the antenna had it always provides its greatest gain in the direction of an appropriate satellite. This however, is an ideal and is not achievable in practice using existing mobile antenna technology.

An antenna type with some of these features is the helical antenna and the type of helical antenna most commonly used for mobile satellite communications is the quadrafilar helix antenna.

U.S. Pat. No. 5,489,916 to Waterman et al. is an example of such an antenna, which comprises four parallel conductive helices extending about a common vertical central axis. The helices have a common direction of turn about the axis, a common pitch, and a common length between opposite ends. The helices are uniformly radially spaced from each other by 90°, and a single non-conductive (dielectric) helix concentric with the common axis having a pitch much greater than the conductive helices, lies within and supports the conductive helices at a nominal diameter. A casing containing all the helices is secured to one end of the non-conductive helix. A radio frequency tuning device is secured to the other end of the non-conductive helix as well as the conductive helices and is rotatable with respect to the casing. Rotation of the tuning device rotates the non-conductive helices, which alters the common pitch of the conductive helices without substantially varying of the nominal diameter of the conductive helices. The spacing and angle between the common helices remains uniform throughout its length.

The Waterman et al. antenna configuration allows a circularly polarised quadrifilar helix antenna to transmit and receive tuned frequency beams Omni-directionally having maximum gain at a selectable angle in elevation relative to the horizontal (the azimuth angle). For example, a maximum gain beam at an elevation angle of 60° may be required to efficiently receive and transmit to a low-earth orbit satellite at one moment and at the next moment at an elevation angle of 30°. Such agility is required so that the same antenna can receive and transmit with two low-earth orbit satellites until the transceiver can determine which LEO satellite is in a position to provide the strongest signal. In general as the pitch of the conductive helices increases the angle of elevation above the horizontal of the beam of maximum gain increases and it is the controlled changing of the pitch which is used to alter the radiation pattern of the quadrifilar antenna.

Since a mobile is likely to be moving relative to the satellite, be it a geo-stationary or low-earth orbit satellite, it is preferable for the mobile's antenna to be agile in its ability to alter the elevation angle of the beam having the greatest gain. Elevation angle agility is also required to account for times when the mobile antenna moves off the vertical. Such as, for example, when the vehicle to which the antenna is fitted, traverses undulating ground, more so since the nature of this type of reorientation of the antenna is not predictable and can be very dramatic. may receive unwanted signals and/or deplete transmit efficiency by transmitting signals in unwanted azimuth angles.

Further it is of some importance, for the elevation angle of the main beam to be selectable over as great a range as possible. The ideal being between 0° and 90° to ensure that both the sky directly above and the horizon are traversed either during a general scan or during relative movement.

Some of these ideals are not achievable with antennae of the prior art certainly not in the one antenna. It is an aim of this invention to provide an antenna that reduces or eliminates some of the shortcomings of the prior art or at least provides an alternative mechanism for creating them.

BRIEF DESCRIPTION OF THE INVENTION

In a broad aspect of the invention an helical antenna comprises at least one conductive helix having a vertically orientated central longitudinal axis wherein the helix is fixed at one end and rotatable at the opposite end; a non-conductive constant diameter support means located coaxial with said at least one conductive helix adapted to support said at least one conductive helix; and rotation means attached to said rotatable end of each of said at least one conductive helix arranged to change the pitch of said at least one conductive helix while maintaining the diameter of said at least one conductive helix.

In a further aspect of the invention the rotation means comprises a motor with a driven shaft connected to a connecting arm located between the driven shaft and the rotatable end of each of said at least one conductive helix which provides both rotation and vertical translation with respect to said driven shaft while maintaining the diameter of said at least one conductive helix.

In yet a further broad aspect of the invention an helical antenna comprises at least one conductive helix having a vertically orientated central longitudinal axis wherein said helix is fixed at one end and rotatable at the opposite end; a non-conductive support means located coaxial with said at least one conductive helix adapted to support said at least one conductive helix; and rotation means attached to said rotatable end of each of said at least one conductive helix arranged to change the pitch of said at least one conductive helix while allowing the diameter of said at least one conductive helix to change.

In a further aspect of the invention the shaft is connected to said connecting arm by a screw thread which rotates and translates with respect to said driven shaft along the vertically orientated central longitudinal axis such that rotation to tighten the helix proportionally shortens the length of the helix while allowing the diameter to increase, decrease or remain constant.

In a further broad aspect of the invention an helical antenna comprises at least one conductive helix having a vertically orientated central longitudinal axis wherein said helix is fixed at one end and rotatable at the opposite end; a non-conductive constant diameter support means located coaxial with said at least one conductive helix adapted to support said at least one conductive helix; at least one means to stop rotation of a portion of at least one said conductive helix; and a rotation means attached to said rotatable end of each of said at least one conductive helix arranged to change the pitch of said at least one conductive helix.

In another aspect of the invention a non-conductive constant diameter support means located coaxial with said at least one conductive helix comprises fixed diameter cylindrical support members within which said at least one helix is located that limit the minimum and maximum diameter of said helix.

In a further aspect of the invention said conductive helix is supported on an electro-strictive material that when energised controls the stiffness of the helix support material.

Specific embodiments of the invention will now be described in some further detail with reference to and as illustrated in the accompanying figures. These embodiments are illustrative, and not meant to be restrictive of the scope of the invention. Suggestions and descriptions of other embodiments may be included but they may not be illustrated in the accompanying figures or alternatively features of the invention may be shown in the figures but not described in the specification.

BRIEF DESCRIPTION OF THE DRAWINGS

FIG. 4A depicts a pictorial representation of the path of a helix in an antenna and the relationship between its pitch, diameter and in FIG. 4C the azimuth angle of the main beam of a helical antenna;

FIG. 4B depicts a pictorial representation of the path of a helix in an antenna and the relationship between its pitch, diameter and in FIG. 4C the azimuth angle of the main beam of a helical antenna;

FIG. 4C depicts the two main beam pattern locations resulting from the same antenna having the same pitch but different diameters;

DETAILED DESCRIPTION OF EMBODIMENTS OF THE INVENTION

Figure 1:
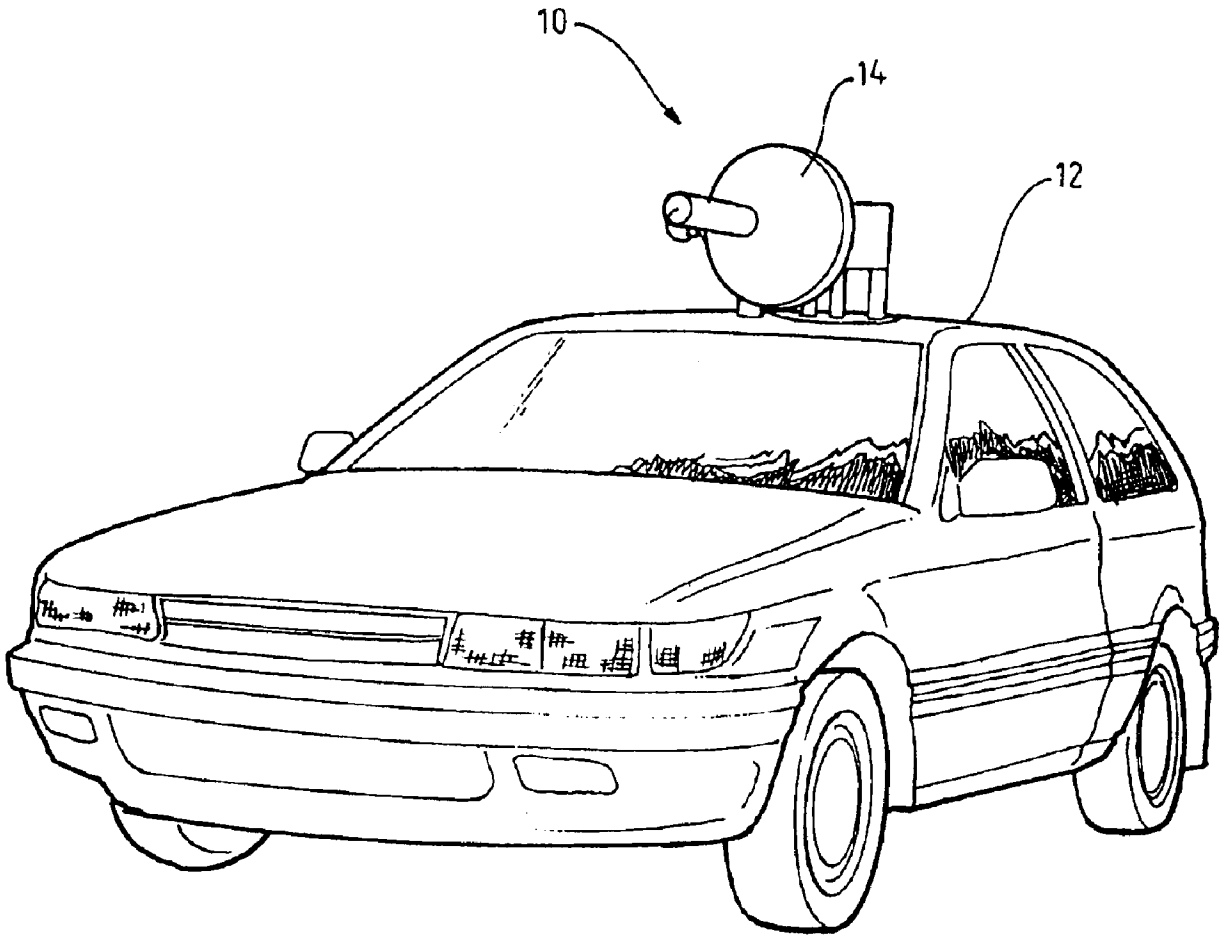
Fig 1 PRIOR ART
FIG. 1 depicts a vehicle mounted parabolic antenna of the prior art.

FIG. 1 depicts a prior art parabolic antenna 10 fitted to the roof of a vehicle 12. The actual concave parabolic shape of the antenna is hidden from view by a convex shaped radio transmissive radome 14. A radome is designed to shape the antenna so as to reduce its wind resistance and protect the radio wave receiver device located at the focus of the parabolic shape which itself maybe the opening of a wave guide designed to capture and carry the signal to a receiver.

An antenna of this type is very directional and may be used to transmit and receive to and from geo-stationary and LEO satellite systems. However, its very directional beam must be very accurately directed towards the satellite providing the strongest signal at the time. This although possible is not trivial in terms of the mechanical and radio signal engineering required and has met with limited success. Most commonly the user stops their vehicle and manual or automatic antenna orientation of the antenna occurs before reliable communications can commence. Furthermore this type of antenna, as previously stated is better suited to establishing links to geo-stationary satellites.

Figure 2:
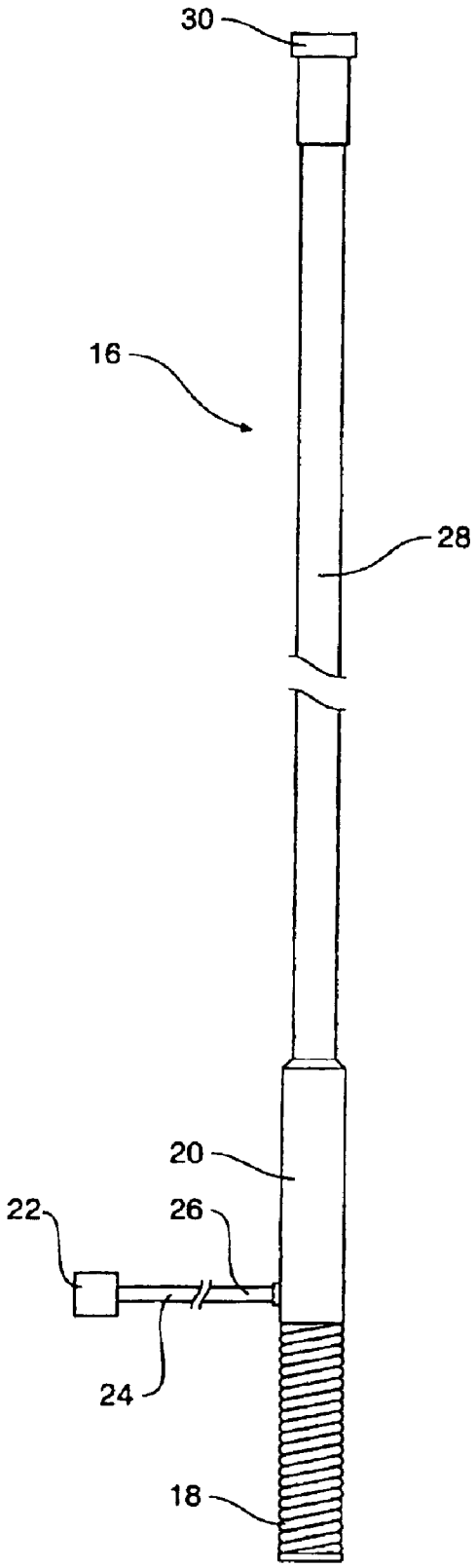
FIG. 2 depicts an external view of an embodiment of a helical antenna of the invention.

FIG. 2 depicts a generally column like antenna assembly 16 which is, in this example, fitted to a vehicle (typically its bumper bar) with a vertical orientation. The spring base 18 provides a means for isolating the antenna, to some extent, from the movement of the vehicle chassis. When the movement of the vehicle is extreme the antenna can move about the vertical and the spring biases the antenna back to a vertical orientation with respect to the bumper bar. However, the spring can not always bring the antenna back to the vertical with respect to the ground since the vehicle itself my not be level with respect to the ground.

The lower portion of the antenna contains an impedance matching circuit and the outside of the antenna impedance matching section comprises a casing 20. Attachment of coaxial cable (not shown) that connects the antenna to the vehicle's satellite transceiver is achieved using connector 22 which has its own length of coaxial cable 24 entering the casing 20 through grommet 26 to the impedance matching circuit.

A cylindrical radome 28 encloses the conductive elements of the antenna that extend from the lower positioned casing 20 to the top of the antenna 30. In the example to be used in this specification four flat ribbon like conduction elements arranged with a shape of a helix are used. Such an element is sometimes referred to as a "filer". However it is possible to apply the invention disclosed to one or more conductive elements arranged along the length of the assembly 16.

Figure 3A:
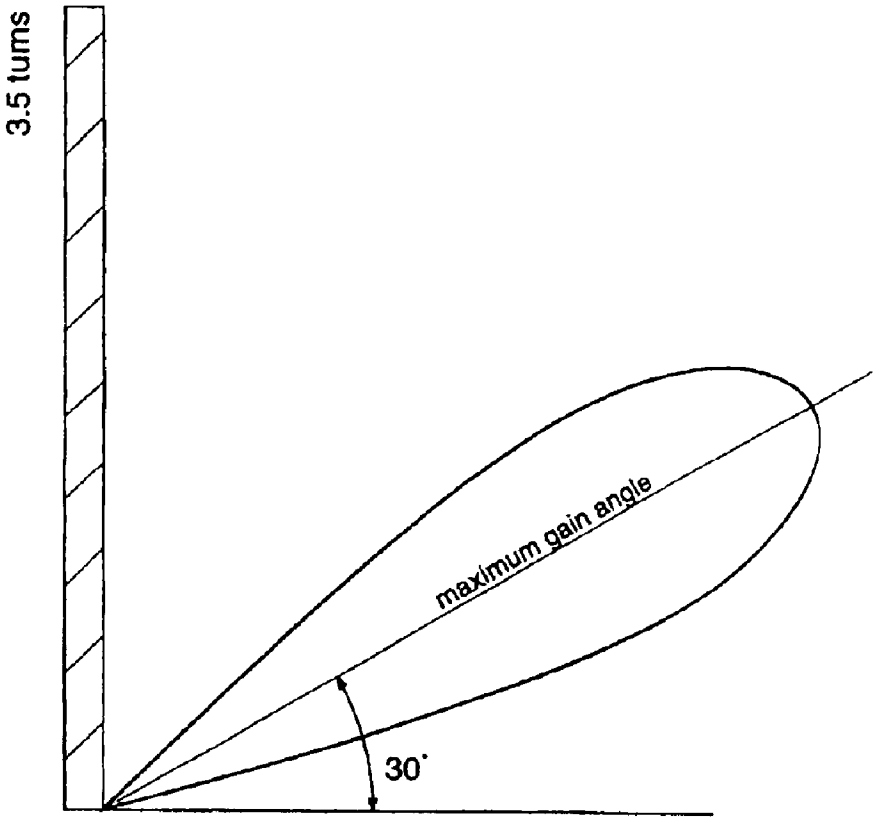
FIG. 3A depicts a pictorial representation of the relationship between the pitch of a helical antenna and the azimuth angle of the main beam, its so-called launch angle of 30 degrees.

FIG. 3A is a pictorial representation of the relationship between the pitch "Filer angle" (the distance along the longitudinal axis of an antenna of a single turn of a filer) of a helical antenna and the azimuth angle of the main beam, its so-called launch angle. In this example the launch angle is shown as being 30 degrees. The vertical rectangle is representative of the outer shape of a helically wound conductive element. The sloped lines are representative of a conductive element as it winds its way along the length of the antenna assembly. Only one conductor is shown for clarity, but in a quadrafilar antenna there are four such conductive elements spiralling upward parallel with each other. Each conductive element is typically a thin flat ribbon of copper supported on a relatively stiff (with respect to the copper ribbon) non-conductive ribbon (typically Mylar).

In an actual antenna, there maybe 8 to 9 turns along the length of the assembly and there is sufficient adjustable length in the assembly of the antenna allow the filers to rotate an additional 3 and a half times. In one embodiment such rotation is achieved while maintaining the diameter fixed or and in another embodiment allowing it to vary.

Figure 3B:
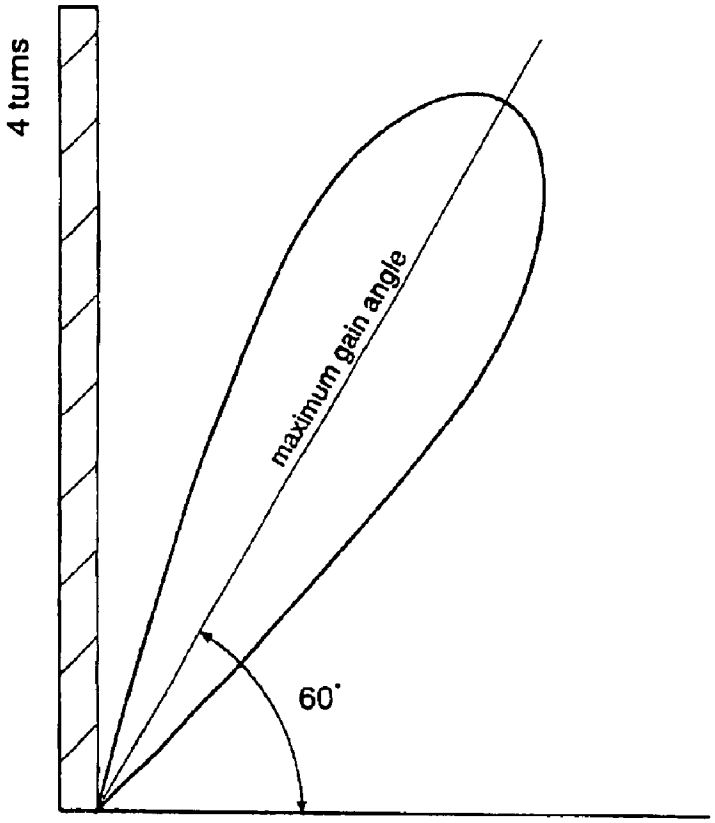
FIG. 3B depicts a pictorial representation of the relationship between the pitch of a helical antenna and the azimuth angle of the main beam, its so-called launch angle of 60 degrees.

The general rule is that the lower the pitch, the higher slope of the conductive filer with respect to horizontal and thus the lower launch angle, also with respect to the horizontal. In FIG. 3A the filer turns 3.5 times over the length of the antenna assembly and in FIG. 3B the filer turns is 4.25 times over slightly less length. Thus contrast the launch angle of the arrangement in FIG. 3A with the higher launch angle depicted for the arrangement in FIG. 3B. In this example the diameter of the helices is kept constant.

Of course the conductive filer in a preferred arrangement is fixed to a matching circuit at its lower end and does not rotate while the upper end rotates. This arrangement is referred to as being bottom fed, the opposite arrangement is referred to as being top fed. Thus the pitch is not exactly the same along its full length and it may be slightly less at the bottom and top of the antenna in this example because the filers are mechanically fixed around the circumference of the end elements. This factor is of some consequence to the characteristics of the invention, in the experience of the inventor as most of the power radiates from the distance of the first wave length along the antenna from where it is fed. Hence it may be of some consequence on the filer angle along the length of the antenna near to the end of the antenna assembly in regards the way in which the filer pivots at its attachment point.

FIG. 4A shows a two dimensional pictorial representation of the path of a helix in an antenna assembly and the relationship between its pitch of three and a half and a diameter of x and the resultant azimuth angle of the main beam depicted as beam X in FIG. 4C.

FIG. 4B depicts a pictorial representation of the path of a helix in an antenna and the relationship between its pitch of three and a half and a diameter of y and the resultant azimuth angle of the main beam depicted as Y in FIG. 4C.

FIG. 4C depicts the two main beam pattern locations having the same azimuth angle but the beam denoted as Y having greater gain than the beam denoted as X resulting from the same antenna having the same pitch but different diameters. Of note is that the beams X and Y are shown in cross-section wherein the representation is merely of the 3 dB envelope of the radiation pattern showing how it is radiated/received Omni-directionally in the horizontal plane and pointing skywards 30 degrees (its azimuth angle).

It will also be noted that there is a representation of a smaller beam (3 dB envelope) or lobe, that can exist at other azimuth angles but to a much lesser extent. Typically, their will be one or more of these lobes and their gain is well below that of the main beam. Such lobes can only be minimised and not eliminated even though they lessen the efficiency of the antenna.

Figure 5B:
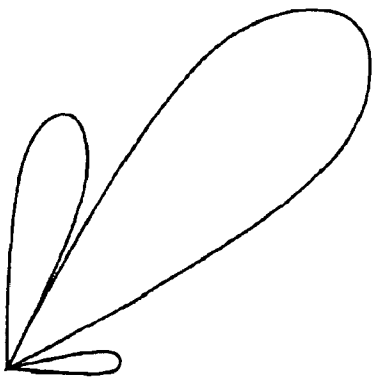
FIG. 5B depicts a partial cross-section in pictorial form of the main beam and other smaller gain beams of a helical antenna when the helix is stopped along its length as the length and pitch is changed and the diameter is kept constant.
Figure 5A:
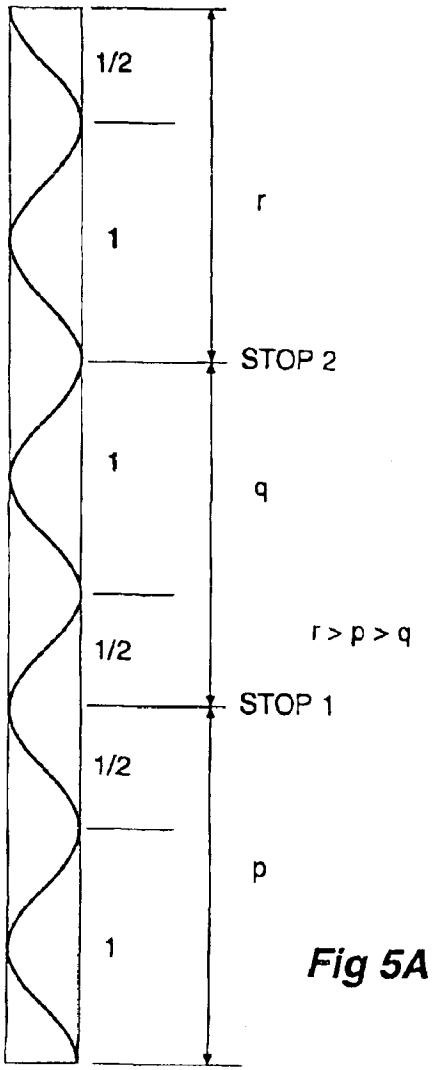
FIG. 5A depicts a pictorial representation of a helix that has been stopped along its length while the diameter is kept constant.

FIG. 5B shows a two dimensional pictorial representation of the angle of the main beam and other beams of a helical antenna when the helix is stopped along its length as the length and pitch is changed while the diameter is kept constant as is depicted in FIG. 5A.

The helix at the bottom of the antenna assembly is one and half turns over a distance of p then a stop 1 prevents the helix turning any more below the stop and the pitch is fixed along that portion. The helix continues to rotate but at a lesser rate and over the smaller distance q and turns one and a half times until stop 2 is engaged and the helix stops turning.

Above stop 2 the helix continues to turn one and a half times over a distance of r which is a greater distance than both p and q.

In this example all the above is done while the diameter of the helix remains constant.

An approximate representation of the resultant beams is depicted in FIG. 5B. Such an array of beams could be used to transmit or receive to and from one or more transceivers above the horizon obviously at different azimuth.

Figure 6B:
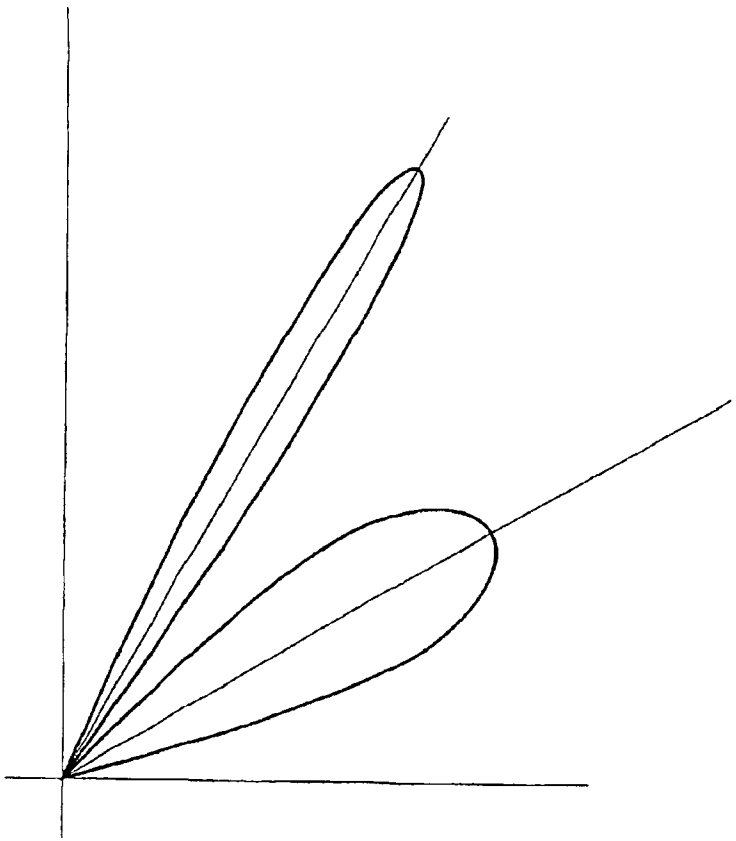
FIG. 6B depicts a partial cross-section in pictorial form of the angle of the main beam and further beam of the same helical antenna when the helix is stopped along its length as the length and pitch is changed while the diameter is varied.
Figure 6A:
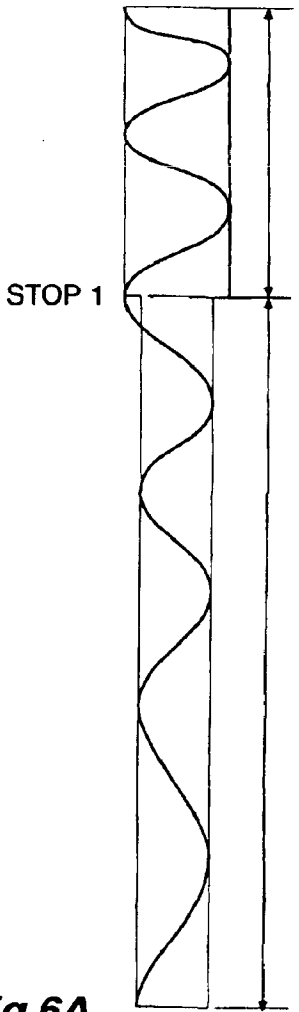
FIG. 6A depicts a pictorial representation of a helix that has been stopped along its length while the diameter varies from section to section.

FIG. 6A depicts a pictorial representation of a helix that has been stopped along its length while the diameter varies from section to section.

The helix at the bottom of the antenna is three turns over a distance of u then a stop 1 prevents the helix turning any more below the stop and the pitch is fixed in that portion. The helix continues to rotate but at an increased rate and over a smaller distance v and turns twice.

All the above done while the diameter of the helix is varied such that below stop 1 the diameter is smaller than above stop 1.

FIG. 6B depicts a pictorial representation of the angle of the main beam and another beam of a helical antenna when the helix is stopped along its length as the length and pitch is changed while the diameter is varied.

FIGS. 3A, 3B, 4A, 4B, 4C, 5A, 5B, 6A and 6B all depict various configurations of the possible arrangement of the filers under the control of those embodiments of the constant and variable diameter filer arrangement.

In this invention a means to encompass each filer and either restrict or control its radial excursions is termed a shoe. Shoes are depicted on FIG. 10 that allow for the radial spacing of the filer from the longitudinal axis of the antenna to increase and decrease its radial position in a controlled manner. Ideally, the type of control provided allows there to exist different radial spacings of each filer along the length of the antenna as well as situations when the shoe is arranged to maintain a constant radial distance of the filer from the longitudinal axis of the antenna.

Thus, it is possible to control the following characteristics in the following manner; maximum to minimum height; maximum to minimum pitch while having variance between maximum to minimum radially spaced filers. Details of the method and means to control some of these characteristics have been described and use of the function of the shoe that controls the diameter of the radius formed by the helically wound filer and vary the pitch of the filer will be described later in this specification.

Figure 7:
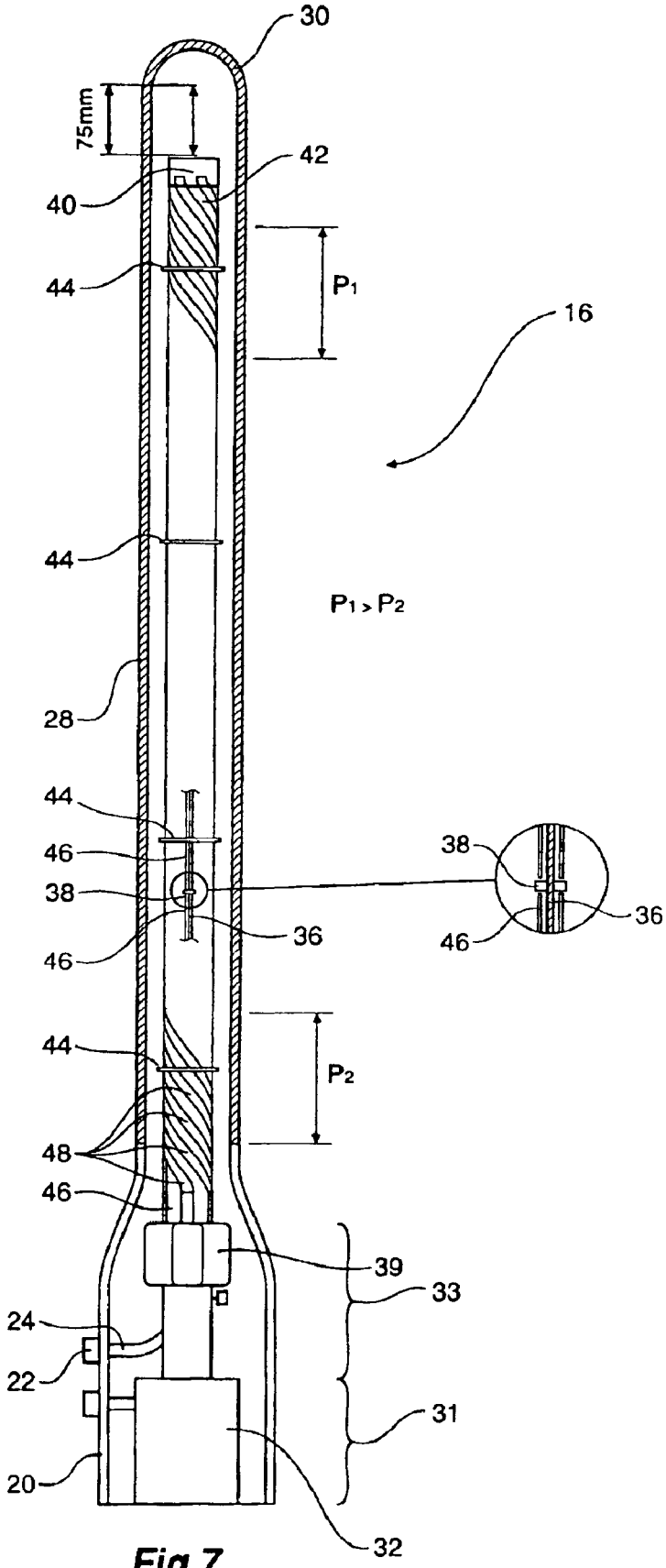
FIG. 7 depicts an embodiment of a quadrafilar antenna according to the invention that provides the ability to vary the pitch and length of the quad helix while maintaining the diameter.
Figure 8D:
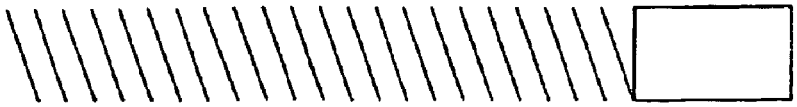
FIG. 8D depicts a screw thread that provides the ability of the antenna to vary the pitch, length and diameter in a controlled manner.
Figure 8C:
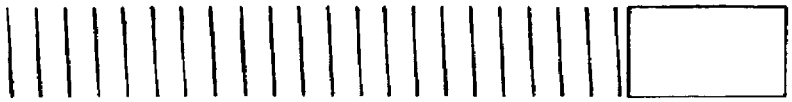
FIG. 8C depicts a screw thread that provides the ability of the antenna to vary the pitch, length and diameter in a controlled manner.
Figure 8B:
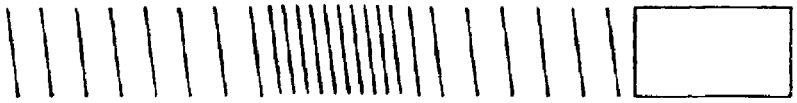
FIG. 8B depicts a screw thread that provides the ability of the antenna to vary the pitch, length and diameter in a controlled manner.
Figure 8A:
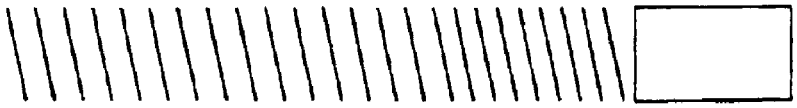
FIG. 8A depicts a screw thread that provides the ability of the antenna to vary the pitch, length and diameter in a controlled manner.

FIG. 7 depicts an embodiment of a quadrifilar antenna according to the invention that provides the ability to vary the pitch and length of the helix while maintaining its diameter.

In FIG. 7 where applicable, like elements to those in FIG. 2 are similarly numbered.

In this embodiment a four-phase stepper motor 32 is installed at the base of an antenna structure 16. A shaft approximately 75 mm long (not shown as it hidden by the hollow impedance matching circuit 33) exits the top of the motor 31 and connects directly to a longitudinal screw thread which rotates in a complimentary threaded bolt 39 fixed to the base of the antenna. The top portion of the longitudinal screw thread is attached to a rod 36 (preferably approximately 3 mm outer diameter). This rod is housed in hollow tubes 46 located between spacers 38 (preferably 5 mm inner diameter) both shown in breakaway view at a location approximately ⅓ along the height of the antenna. The rod, the tubes and spacers are made of non-conductive material, preferably plastic or nylon. The rod 36 extends to the top of the antenna 16 and connects to a nylon bush 40 from which depends filers 48 (conductive strips which wind down in a helical path at a constant radial distance from the longitudinal axis of the antenna).

Rotation of the motor shaft rotates the screw thread, which in turn rotates and raises or lowers the rod dependant on the direction of the rotation of the motor. Movements up or down are approximately 75 mm longitudinally.

The pitch of the thread determines the number of rotations of the top bush 40 relative to the current adjustment in length along the longitudinal axis of the antenna.

In this example four filers 48, a portion of which is a conductive material, are attached at the top of the rod to the teflon bush 40 and spiral downwards in a helical path parallel to each other within the radome shell 28 of the antenna. The four filers 48 are attached, preferably, by pivot means, to the bottom collar 46 of the antenna and then each conductive filer is electrically connected to a respective portion of the impedance matching circuit 33.

Although, a matter of known design the matching circuit is arranged so that each filer, in this example in a quadrafiler arrangement, is electrically ¼ wave length different to an adjacent filer.

With the preferred arrangement described, the longitudinal length of adjustment of the rod is as described previously, 75 mm, and is achieved while the screw thread turns 3.75 times for over 360° of the bush 40 providing a total rotation of 1350° during the 75 mm vertical movement.

The particular characteristic of the screw thread of the embodiment is but one of an infinite variety and there will be others which will provide advantageous effects to the radiation pattern of the antenna arranged in the above-mentioned way. FIGS. 8A–D pictorially illustrate some of the variations of pitch of the thread of the screw thread device which will vary the shape and configuration of the filers in question.

The helical filers are effectively suspended in air and the pitch of the filers in the preferred embodiment is kept constant over the length of the antenna without assistance from any external support, due mainly to the stiffness of the filer material.

However, as described previously, the starting pitch, diameter and the number of turns provided to the filer supporting structure will have a direct relationship to the current pitch. It is preferable that the screw thread be arranged to provide the correct relationship between pitch and length so that the filers do not fall slack or tighten too heavily.

Figure 10:
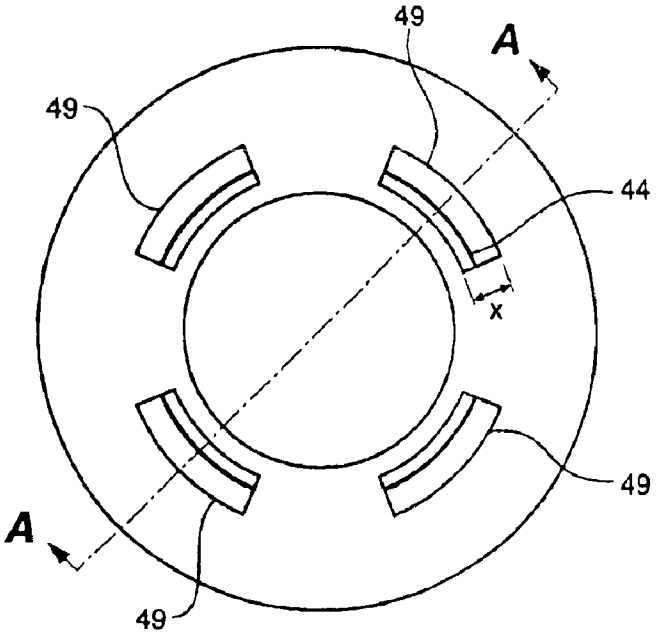
FIG. 10 depicts a plan view of the shoe arrangement used in FIG. 9 to guide the radial position of the conduction filers.
Figure 9:
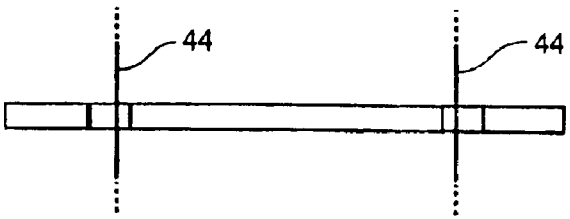
FIG. 9 depicts a side view of shoe used to guide the conductive filers.

In this embodiment, an element, better illustrated in plan view in FIG. 10 and sideview FIG. 9 is a positioning element of generally annular shape, herein referred to as a shoe 44. This term has no know technical meaning. It has been used by the inventors during development of the invention as it is convenient for describing the function of the positioning of the filer in space about the longitudinal axis of the antenna as each filer fits into a shoe like housing or space and therein is cradled in space in an appropriate manner.

The shoe is preferably made of non-conductive material and in a preferred arrangement is made of Teflon.

The annular shoe depicted in FIG. 10 has four slots 49 through which are threaded the four filers, one per slot.

Slots are positioned the same radial distance (in this embodiment approximately 18 mm from the centre of the shoe) and thus arranged to maintain the filer at a constant radius from the longitudinal axis of the antenna.

The outer diameter of a shoe (in this embodiment is approximately 20 mm) such that it can easily fit within (without contact), the inner diameter of the radome 28.

Thus in the arrangement described, four filers are suspended in the air and in this particular embodiment bottom fed with radio frequencies to be radiated by a transmitter or reciprocally receive radio frequencies for conduction to a radio frequency receiver via the matching circuit and intervening cables.

The shoes are spaced longitudinally, in this embodiment, approximately 40 mm apart.

To maintain the longitudinal spacing of the shoes tubes 46 of inner diameter suitable for sliding without contact over the rod 36 and of appropriate length, sit between each shoe and between the lower shoe and the bolt 39 along with spacers 38.

These tubes are non-conductive and are also preferably constructed of PTFE material or nylon. Bushes (spacers) of high slip teflon can also be used to interface between the ends of the tubes 46 and the shoes, so as to reduce the friction that occurs during the turning of the shoe while the pitch of the filers are adjusted.

Each filer 48 is preferably constructed of copper track adhered to a plastic or mylar backing strip which is stiff enough to maintain its shape in the conditions described. The current carrying capacity of the filers is determined by the cross sectional area of the copper track and its radiation pattern is not largely dependent on the width of the track but more related to the pitch and radial distance or diameter of the helical paths of the suspended copper tracks.

A feature of the shoe depicted in FIGS. 9 and 10 is that the slots 49 have a width x, which is not much greater than the width of the mylar strip of the filer 48. Thus, if the pitch and turns of the screw thread are appropriate the filer will maintain substantially constant radial distance without too much guidance by the shoes which in that circumstance are there mainly to maintain angular separation of each filer. Nevertheless the shoe also maintains the radial distance from the longitudinal axis of the antenna.

In an embodiment, functionally related to FIGS. 5A, 5B and 6A, 6B, the stops are arranged to be held at a predetermined fixed longitudinal distance along the antenna height. The mechanism for doing so (not shown) may comprise, in one embodiment, a pin manually fitted from outside the antenna that extends within the radome sufficiently enough so as to stop the shoe from moving upwards or downwards during the movement of the inner rods. Consequently the pitch of the filer below the shoe is fixed while the pitch above continues to change. In any embodiment in which the shoes may need to move up or down the length of the spacing tubes need to be appropriate or eliminated as required.

This particular configuration requires manual intervention, however automatic alternatives using computer-controlled sensors and actuators to achieve a similar functionality are also possible.

As a guide only, initially 8 turns of filer are wound onto the structure described above, which when used, provides the lowest azimuth radiation angle being just above 0°.

Once the antenna is rotated further, so as to achieve a total rotation of 11.5 turns, the now shorter antenna that occurs because it is necessary to maintain the diameter, exhibits an azimuth radiation angle of just below 90°.

The number of turns created along the length of the antenna is indicative of the optimum operational frequency. The relevance of the Q value of the antenna at its extremes of pitch and length. Preferably the Q should be kept high for a particular frequency or for a band of frequencies within which the transceiver is required to operate.

FIG. 10 depicts a shoe that is used to guide the conductive filers of a quadrafiler antenna. The shoe as described previously comprises a non-conductive material such as for example Teflon. The four slots in the shoe are of the same shape and width through each of which is thread one filer per slot. The slot can be made wide enough for the filer to move inwards and outwards thus effectively decreasing and increasing the effective diameter of the conductive filers. This latitude of movement can result in an advantageous effect relating to the gain of the antenna being enhanced across its full frequency band. The use of the slightest diameter variation can be accommodated by appropriate design of the drive shaft thread as described previously.

Figure 11:
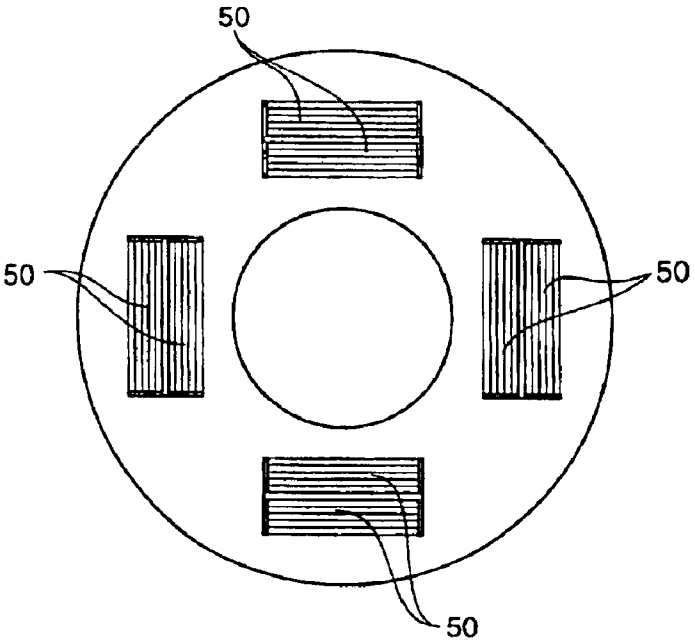
FIG. 11 depicts a yet further shoe arrangement having the ability to allow the filers to move radially.

FIG. 11 depicts one embodiment of a particular shoe having slots that are arranged to allow the diameter of the filer helix (the radial distance of each filer from the longitudinal axis of the antenna) to vary inwards and outwards in a controlled manner.

Such variability may come into play when the screw thread is arranged to vary the length of the helix in such a manner that the filer needs to tighten or loosen as the case may be. Having been threaded through the variable diameter slot, the filer is then free to adopt the required new radial spacing.

Required screw thread variations are achieved by installing a particular screw thread type at the time the antenna is manufactured. However, future mechanical developments of the antenna may provide the ability to adjust the individual length and rotation of the filers independent of one another, avoiding the use of the screw thread device described.

The adjustability range of the slot may be achieved by providing in its simplest form, a wider slot within which the filer can freely move inwards and outwards.

In a yet further arrangement, bias members 50 are fitted into the slots so that it is possible to allow radial movement of the filer against a bias which is set to radially centralize the fliers between the bias members when otherwise not in use. The biasing member 50 in a simple embodiment comprises a concertina of non-conductive plastic material.

Figure 12:
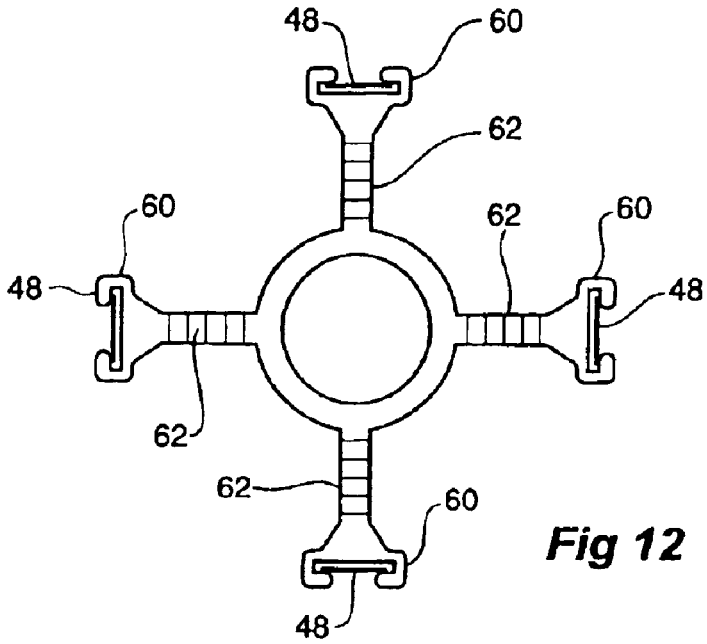
FIG. 12 depicts yet another shoe arrangement that fixes the radial distance of one set of four filers.

FIG. 12 depicts a further embodiment of a shoe having an arrangement of radially spaced claws 60 that are designed to capture each filler 48 and position the filler a predetermined radial distance from the central longitudinal axis of the antenna.

Figure 13:
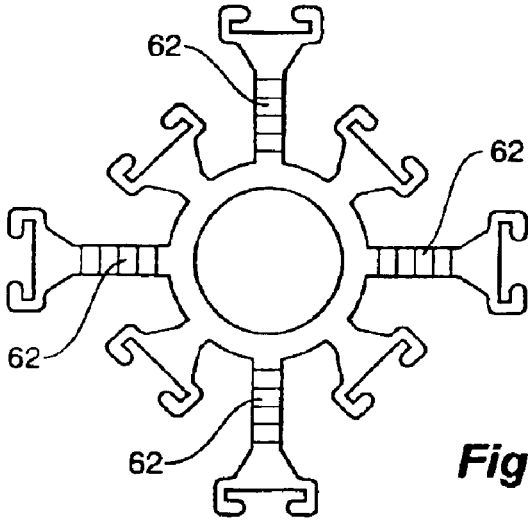
FIG. 13 depicts yet another shoe arrangement that fixes the radial distance of one sets of four filers having an arrangement that allows the filers to move radially

In the embodiment depicted in FIG. 13 it can be seen that 8 filers are used, 4 of which are spaced one radial distance and the remaining 4 of which are spaced a different radial distance.

FIGS. 12 and 13 depict a shoe having an arrangement of radially spaced claws 60 for 4 filers. This shoe arrangement differs from the shoe arrangement depicted in FIGS. 10 and 11 in that the stems 62 of the radially spaced claws can shorten in length as is shown by supplementary FIGS. 13*a*, 13*b* and 13*c*.

Figure 13A:
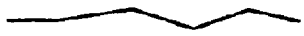
FIG. 13*a* depicts a fully extend stem and claw of the shoe depicted in FIG. 13.
Figure 13B:
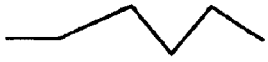
FIG. 13*b* depicts a partially extended stem and claw of the shoe depicted in FIG. 13.
Figure 13C:
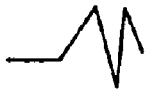
FIG. 13*c* depicts a fully compressed stem and claw of the shoe depicted in FIG. 13.

FIG. 13*a* depicts pictorially in cross-section, the fully extended claw which may or may not be biased to this position because of the choice of material it is made from. FIG. 13*b* depicts the stem of the claw, slightly compressed by way of a concertina effect, while FIG. 13*c* shows the compressed shape of the stem.

Such an arrangement allows the filer to adapt a required diameter when used in conjunction with the other features disclosed herein.

In more general terms, having described the theory of operation and mechanical arrangement for achieving a desired function, it is possible to understand that there are a number of possible applications for a frequency and radiation pattern agile antenna of the type described herein.

The stepper motor and its associated mechanical elements are capable of adjusting the configuration of the helix such that the azimuth angle is say 87° maximum to a minimum of 3° in the period of a second or so. This period may even be smaller with improvements in design and components.

Such an operation is useful for scanning the horizon to determine the location of one or more satellites and thereafter determining, even within the short time within which the scan is completed, which satellite being received is providing the best signal.

This method of operation of a quadrafiler antenna is unknown to the inventors, since previous antennas were unable to scan the full azimuth range of angles nor were they able to do so in a period of time during which it was possible to maintain communications in certain circumstances.

Furthermore, such an antenna when used on its side, say horizontally disposed on an aircraft, is able to scan forward in one quadrant and scan rearward in another quadrant. Such an arrangement is achievable by using two such antennas both fitted to the top and/or bottom of the aircraft. One of the pair of antennas would scan above and forward of the aircraft and the other of the antennas would scan above and backwards. Thus as the aircraft flies in a line or even changes direction, it is still possible for the two antennae to find and lock on to the best satellite signal or other frequency source.

In a radar like application it may be possible to adjust the tuning of the antenna to follow a received doppler shift of frequencies and thereby determine the characteristic of the received signal not otherwise detectable and thereby facilitating a further characterization of the object producing the doppler shift.

A stepper motor is used to rotate the threaded screw, thus it is possible to control such a device in a programmed manner using a computer device to provide all of the movements required.

A computer device may be present within the antenna housing or may be part of the transceiver device. Design issues regarding interfaces between the controller and the antenna are known in the art.

Clearly, one or more filers could be used in this antenna but a quadrafiler has been used merely by way of example in this specification.

The material used to support the conductive ribbon that is the filer can be of a type that is controllably stiff such as electro-strictive material. Such a material could be controlled by computer means to stiffen and thus retain a particular shape during any desired period. Further variations of the invention are possible, including the use of more than one set of filers used in the same antenna housing. That is, the same transmitter could feed multiple filers. Multiple transmitters using different Radio Frequency signals could use the same or different motors and the same or different control electronics to feed the filers.

A yet further variation is the use of multiple antennae of the above-described configuration arranged so that they are stacked vertically or horizontally.

As there is a high upper frequency range for this antenna, it may be made to operate in continues or pulsed radar mode for radar applications.

Furthermore, arrays of these types of antennae or stacked configurations may be used on ships and aircraft.

Figure 14:
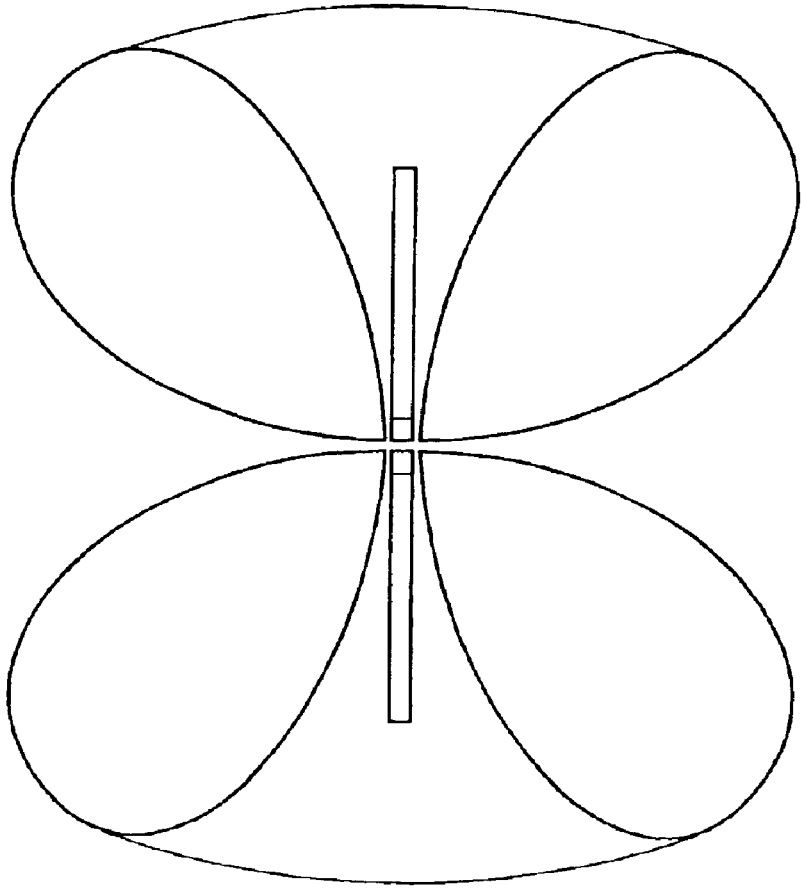
FIG. 14 depicts a base to base antenna configuration and idealised resultant antenna pattern.

Yet a further variation is the use of a single antenna in base to base configuration so as to provide a full 360-degree transmit and receive coverage. As depicted in FIG. 14. The radiation pattern is depicted in cross-section, but in 3-d and from a view above the pattern may appear donut like and from the side like a squashed donut on top of another. This arrangement and others can be used to augment the radiation pattern for particular uses.

Each antenna, comprising one or more filers may have its own transmitter and/or receiver and even each filer of each antenna may have a dedicated transmitter or receiver. Electronic switching of either or both of the transmitters or receivers is possible.

Each filer may have its transmitted or received signal controlled preferably by a PIN diode or other means, for example, semi-conductor switching, to affect the phase of the signal.

Each filer can be resonant at a different frequency to others on the same antenna by making it 1/n or n or n+1 wavelengths.

Each filer can be adapted for operation at different frequencies and radiation patterns by applying grounded areas along their length or creating ground planes on the faces of the ribbon like filer carrier.

Each filer can be fed signal at different points (separately or simultaneously) along its length at the same or different frequencies to affect its radiation pattern and gain.

Each filer can be slotted or otherwise perforated to further affect the radiation pattern and gain characteristics of the arrangement and each slot maybe separately fed with a transmission line signal or may have a strip line reflector there behind as does a synthetic aperture radar.

Figure 15:
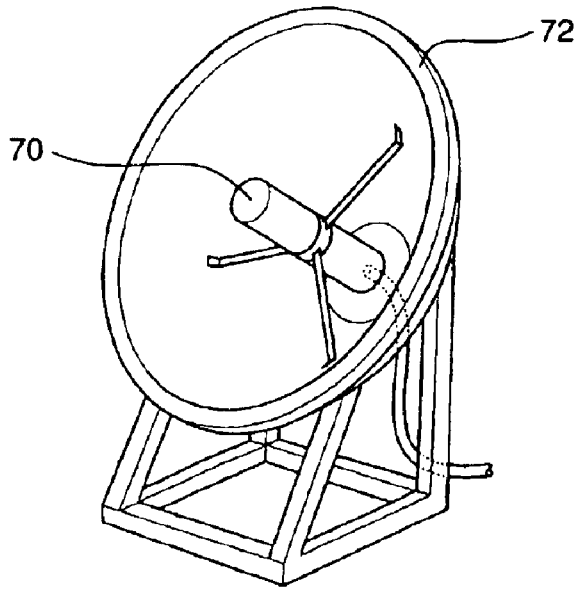
FIG. 15 depicts a single helical antenna and parabolic radiator.

Yet further, incorporating a fixed or moveable reflector to the housing may enhance any of the above variations that could be used specifically to focus antenna radiation and enhance gain. One example of a fixed reflector is depicted in FIG. 15.

In this example the antenna 70 is arranged to radiate to its front or back-fires into a parabolic dish 72, This arrangement changes the apperture of the main beam while the radiation from the antenna is swept (i.e. its nominal azimuth is varied between its extremes). FIG. 15 shows the simplest configuration of the use of a back-fire antenna and parabolic antenna. However, many variations of this theme are possible such as the use of a sub-reflector or cassegrain reflector in the radiation path each of which have known characteristics, advantages and disadvantages. The manipulation of the elevation pattern of the antenna combined with a variable focus parabolic reflector can be used to synthesize a dish antenna with variable beam width. The practical consequence in a radar application is faster scanning in search of a desirable signal. Further, the use of a primary reflector is clearly not restricted to parabolic reflectors. Alternatives include truncated paraboloid, orange peel paraboloid, cylindrical paraboloid or a corner reflector.

A yet further variation is to mount two antenae orthogonal to each other in the same plane above a parabolic dish and control the radiation pattern from each such that the combined radiation from the parabolic dish is such that both height and azimuth radiation signals are radiated and conversly received.

Polarization of the radiation from any of the antenna arrays described can be made left or right handed or can even be a combined version of the two by controlling the way they are combined in the antenna. Using such an arrangement it will be possible to detect separate receive and transmit signals more readily for particular radar applications where it will be possible to make signal measurements in the x, y and z dimensions using one antenna array and one reflector.

It will be appreciated by those skilled in the art, that the invention is not restricted in its use to this particular application described, neither is the present invention restricted to its preferred embodiment with regards to the particular elements and/or features described or depicted herein. It will be appreciated that various modifications can be made without departing from the principles of the invention. Therefore, the invention should be understood to include all such modifications within its scope.

What is claimed is:

1. A helical antenna comprising at least one conductive helix having a central longitudinal axis wherein said helix is rotatable about the longitudinal axis at one end and not rotatable about the longitudinal axis at the opposite end and wherein an end of the at least one conductive helix is also adjustable along the longitudinal axis;

a plurality of non-conductive positioning elements spaced along and located coaxial with said central longitudinal axis each positioning element adapted to support each of the at least one conductive helix such that the conductive helix can move through the support element and each support element also adapted to maintain an even angular spacing between two or more conductive helix about the longitudinal axis and each support element being rotatable about the longitudinal axis; and a movement element connected to the rotatable and longitudinally adjustable end of each of said at least one conductive helix arranged to change the pitch of said at least one conductive helix by rotating the rotatable end while maintaining or adjusting the diameter of each of said at least one conductive helix by also adjusting the length adjustable end of each of the at least one conductive helix along the longitudinal axis.

2. A helical antenna according to claim 1 further comprising at least one reflector located so that said helical antenna lies at the focus of said reflector such that electromagnetic energy is reflected by said reflector to provide a radiation pattern that changes when said movement means is operated.

3. A helical antenna according to claim 2 wherein said reflector has a parabolic shape.

4. A helical antenna according to claim 1 wherein said at least one non-conductive helix element comprise a support element of electrostrictive material the stiffness of which is controllable by the passage of a control current so as to control the radial spacing of said at least one conductive helix from, the longitudinal axis.

5. An array of helical antennae each helical antenna being according to claim 1 wherein the base of one helical antenna is located adjacent the base of another helical antenna wherein said antennae have a common longitudinal axis to provide a 360 degree combined transmit and receive antenna pattern.

6. A method of operation of a helical antenna according to claim 1 including the steps of;

changing the pitch of said at least one conductive helix to one of two extremes, changing the pitch of said at least one conductive helix to the other said extreme so as to control the radiation pattern of said antenna to the available extremes of azimuth in under one second.

7. A helical antenna according to claim 1 wherein said positioning element is non-conducting material.

8. A helical antenna according to claim 1 wherein said positioning element is annular and substantially planar in shape.

9. A helical antenna according to claim 1 wherein said positioning element comprises a slot for each non-conductive helix within which, in use, a respective one of a conductive helix is located, the slot arranged so that two or more slots are evenly angularly spaced about the longitudinal axis.

10. A helical antenna according to claim 9 wherein said positioning elements further comprise bias elements associated with each slot acting, in use, on the conductive helix located therein to bias the position of the conductive helix in a respective slot to a predetermined radial spacing from said longitudinal axis.

11. A helical antenna according to claim 1 wherein said positioning element has an annular central portion and arms extending radially outwards from the longitudinal axis having a receiving portion for positioning, in use, a conductive helix.

12. A helical antenna according to claim 11 wherein said receiving portions are evenly angularly space about the longitudinal axis.

13. A helical antenna according to claim 11 where in said arms have a bias acting, in use, on the conductive helix to bias the position of said conductive helix radially outwards from said longitudinal axis.

14. A helical antenna according to claim 1 further comprising a spacing element located between respective ones of said plurality of non-conductive positioning elements to maintain the spacing between said non-conductive positioning elements.

15. A helical antenna according to claim 1 further comprising at least one stop located along said longitudinal axis operable to stop longitudinal movement of a non-conductive positioning element.

16. A helical antenna according to claim 1 further comprising at least one stop located along said longitudinal axis operable to stop rotational movement of a non-conductive positioning element.

17. A helical antenna according to claim 1 wherein said conductive helix comprises a conductive material carried by a mylar strip.

18. A helical antenna according to claim 1 wherein said conductive helix comprises a conductive material carried by an electrostrictive material wherein the stiffness of the electrostrictive material is controllable.

19. A helical antenna according to claim 1 further comprising a plurality of frequency feeding points for the feeding of different frequencies to different of two or more conductive helix.

20. A helical antenna according to claim 1 further comprising a plurality of frequency feeding points distributed along a conductive helix for the feeding of different frequencies to each of the feeding points.

21. A helical antenna according to claim 1 further comprising a frequency modifying element associated with at least one of said conductive helix to modify the frequency transmission and reception characteristics of the conductive helix.

* * * * *